US007770254B2

(12) United States Patent
Alexander

(10) Patent No.: US 7,770,254 B2
(45) Date of Patent: Aug. 10, 2010

(54) FLOOR SCRUBBER

(75) Inventor: Gus Alexander, Inverness, IL (US)

(73) Assignee: FNA IP Holdings, Inc., Elk Grove Village, IL (US)

( * ) Notice: Subject to any disclaimer, the term of this patent is extended or adjusted under 35 U.S.C. 154(b) by 1120 days.

(21) Appl. No.: 11/283,661

(22) Filed: Nov. 21, 2005

(65) Prior Publication Data

US 2007/0113368 A1 May 24, 2007

(51) Int. Cl.
*A47L 11/30* (2006.01)

(52) U.S. Cl. ..... 15/321; 15/385

(58) Field of Classification Search ..... 15/321, 15/322, 50.1, 50.3, 24, 29, 385
See application file for complete search history.

(56) References Cited

U.S. PATENT DOCUMENTS 3,705,437 A * 12/1972 Rukavina et al. ..... 15/302
3,748,050 A * 7/1973 Poppitz ..... 401/289
4,037,290 A * 7/1977 Rose et al. ..... 15/345
4,191,589 A * 3/1980 Halls et al. ..... 134/21
4,377,018 A * 3/1983 Cain ..... 15/322
5,228,623 A * 7/1993 Raghavan et al. ..... 239/227
5,400,462 A * 3/1995 Amoretti ..... 15/321
5,449,303 A * 9/1995 McLeod ..... 239/754
5,456,412 A * 10/1995 Agee ..... 239/104
5,560,077 A * 10/1996 Crotchett ..... 15/339
5,711,051 A * 1/1998 Roden ..... 15/321
5,718,015 A * 2/1998 Rohrbacher ..... 15/321
5,826,298 A * 10/1998 Rohrbacher et al. ..... 15/321
5,898,970 A * 5/1999 Straiton ..... 15/321
5,970,574 A * 10/1999 Thrash, Jr. ..... 15/321
6,012,645 A * 1/2000 Poppitz ..... 239/104
6,052,861 A * 4/2000 Keller ..... 15/321
6,151,748 A * 11/2000 Earhart, Jr. et al. ..... 15/321
6,158,678 A * 12/2000 Lange ..... 239/532
6,206,980 B1 * 3/2001 Robinson ..... 134/21
6,216,312 B1 * 4/2001 Rowan ..... 15/321
RE37,162 E * 5/2001 Roden ..... 15/321
6,302,967 B1 * 10/2001 Rohrbacher et al. ..... 134/10
6,370,728 B1 * 4/2002 Burns ..... 15/320
6,378,163 B1 * 4/2002 Moll et al. ..... 15/322
6,514,354 B2 * 2/2003 Rohrbacher et al. ..... 134/10
6,598,262 B2 * 7/2003 Farina ..... 15/321
2001/0000576 A1 * 5/2001 Robinson ..... 134/169 C
2001/0004719 A1 * 6/2001 Sommer ..... 701/23
2002/0184729 A1 * 12/2002 Farina ..... 15/321
2003/0062430 A1 * 4/2003 Cook ..... 239/754
2003/0217430 A1 * 11/2003 Montgomery ..... 15/321
2005/0183231 A1 * 8/2005 Mein ..... 15/321
2005/0198752 A1 * 9/2005 McGraw ..... 15/1.7
2006/0112513 A1 * 6/2006 Tetteh ..... 15/321

(Continued)

*Primary Examiner*—David B Thomas
(74) *Attorney, Agent, or Firm*—Cook Alex Ltd.

(57) ABSTRACT

A floor scrubber for cleaning floor surfaces that includes a cleaning head which defines a downwardly opening cleaning zone having a plurality of spray nozzles connected to a power washer pump for directing pressurized liquid flow streams onto the floor surface during a cleaning operation. The cleaning head further defines a separate downwardly opening vacuum zone connected to a wet/dry vacuum device operable for creating a vacuum pressure within the vacuum zone for removing liquid that has been directed onto the floor surface. The wet/dry vacuum device preferably further is operable for selectively directing a positive air flow into the vacuum zone to facilitate drying of the floor surface after cleaning and vacuum removal of the liquid.

19 Claims, 8 Drawing Sheets

U.S. PATENT DOCUMENTS

2006/0248677 A1* 11/2006 Cho ..... 15/321
2006/0254008 A1* 11/2006 Hahn et al. ..... 15/50.3
2007/0028412 A1* 2/2007 Carter et al. ..... 15/321

* cited by examiner

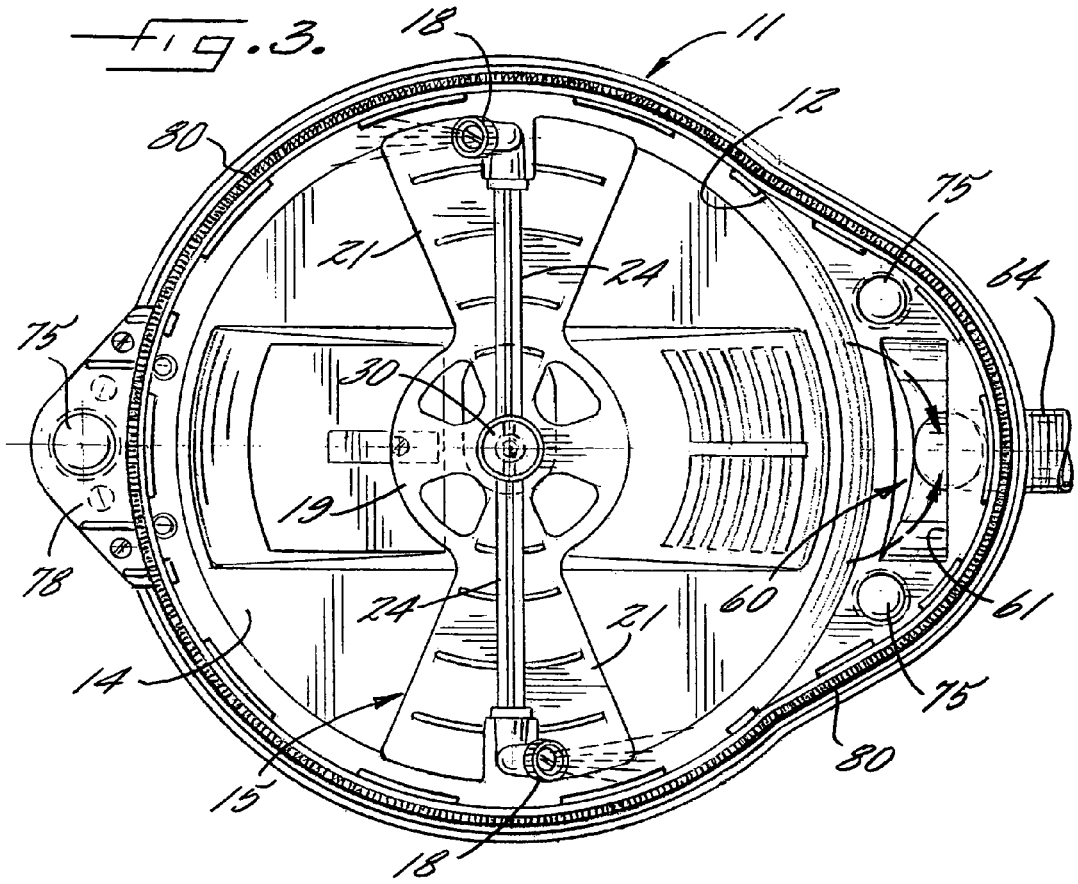
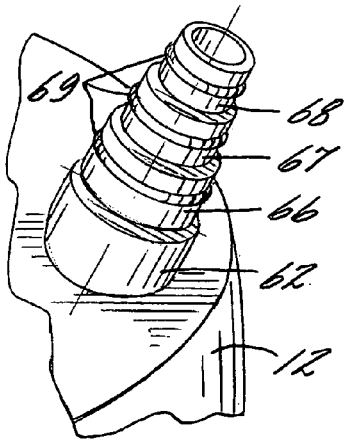
Fig. 4.
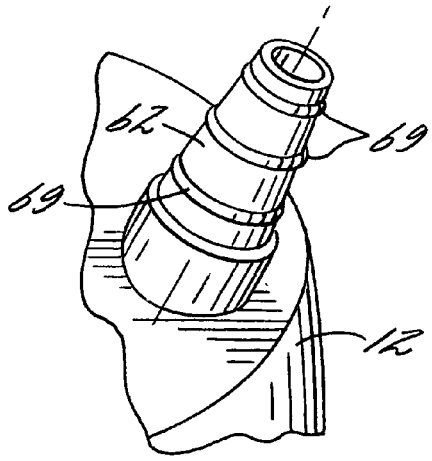
Fig. 4A.

FLOOR SCRUBBER

FIELD OF THE INVENTION

The present invention relates generally to floor scrubbing devices, and more particularly, to scrubbing devices of the type that direct pressurized liquid flow streams onto the floor during a cleaning operation.

BACKGROUND OF THE INVENTION

Floor scrubbers are known of the type which have a cleaning head or housing that is moveable along the floor and which have a plurality of downwardly directed liquid spray nozzles that communicate with a pressurized liquid supply, such as through a liquid flow passageway in a handle of the scrubber. Conventional scrubbers suffer from a number of drawbacks that detract from their widespread efficient usage. Most significantly, while such floor scrubbers can be effective in cleaning floor surfaces, considerable water is directed onto the floor which must later be mopped up or otherwise disposed of to complete the cleaning task. For that purpose, the user of the floor scrubber, often a homeowner, must employ additional means, such as mops squeegees, or the like.

OBJECTS AND SUMMARY OF THE INVENTION

It is an object of the present invention to provide a floor scrubber that is adapted for easier and more efficient usage in cleaning floors.

Another object is to provide a floor scrubber as characterized above which is adapted to eliminate the necessity for later mopping of water directed onto the floor during cleaning.

A further object is to provide a floor scrubber of the foregoing type which is operable for effectively cleaning floors through the direction of pressurized liquid flow streams onto the floor, while simultaneously and/or subsequently removing dispensed liquid from the floor surface following cleaning.

Yet another object is to provide such a floor scrubber that is adaptable for easy and efficient usage with other cleaning items a homeowner or commercial establishment may possess, such as pressure washers and wet/dry vacuums.

A related object is to provide a floor scrubber that is adaptable for use with different sized liquid and/or air conduits of other equipment a homeowner or other user may utilize with the floor scrubber.

Still a further object is to provide a floor scrubber of the above type which is effective for permitting simultaneous application of separately monitored chemicals onto the floor surface during a cleaning operation.

Yet another object is to provide a floor scrubber of such type that has a cleaning head adapted for easy movement and manipulation on the floor surface to be cleaned and which is effective for maintaining a predetermined spatial separation with the floor for optimized simultaneous and/or subsequent vacuum removal of the dispensed liquid.

Other objects and advantages of the invention will become apparent upon reading the following detailed description and upon reference to the drawings, in which:

BRIEF DESCRIPTION THE DRAWINGS

FIG. 3 is an enlarged bottom view of the cleaning head of the illustrated floor scrubber;

FIG. 4 is an enlarged fragmentary perspective of a conduit attachment adaptor for the illustrated scrubber head, taken the plane of line 4-4 in FIG. 1;

FIG. 4A is a perspective, similar to FIG. 4, showing an alternative conduit attachment adaptor for the illustrated scrubber head;

Figure 12:
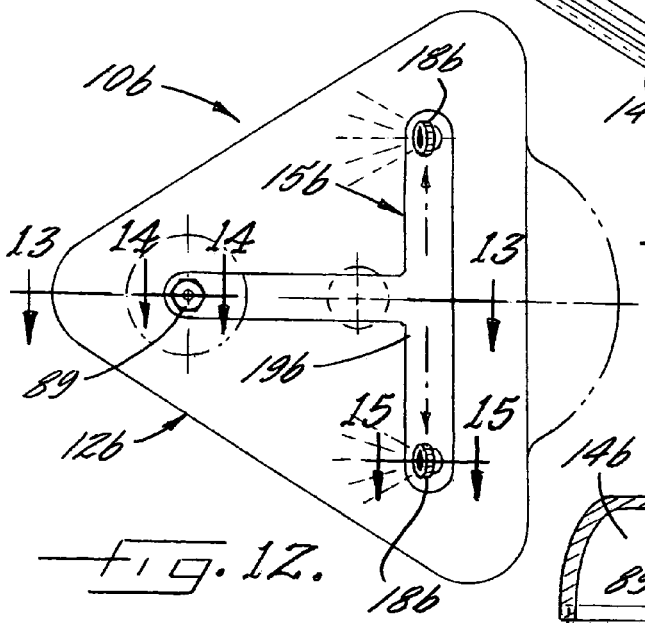
FIG. 12 is an underside view of still another alternative embodiment of floor scrubber in accordance with the invention.
Figure 13:
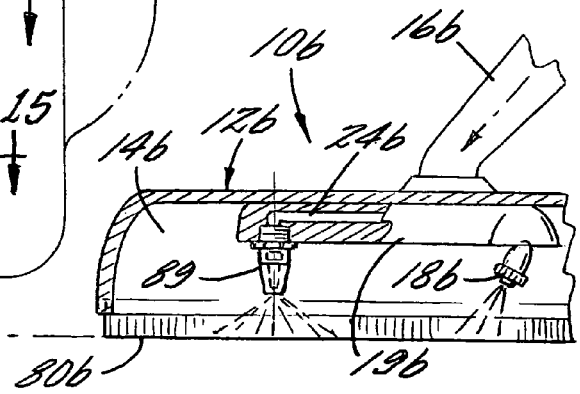
Figure 14:
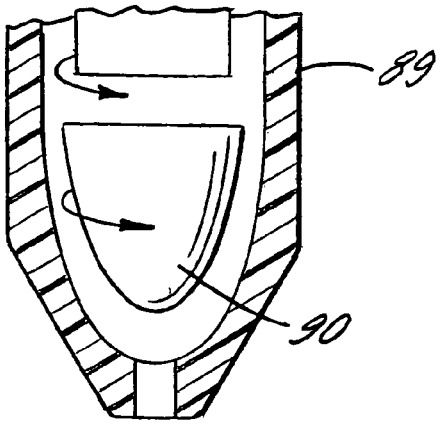
Figure 15:
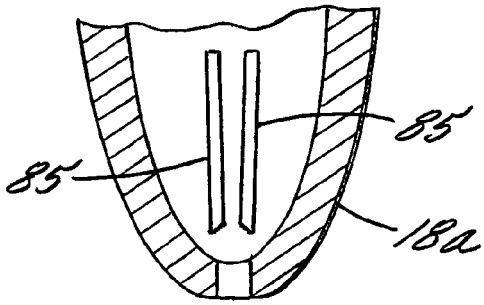

FIG. 13 is an enlarged fragmentary section taking in the plane of line 13-13 in FIG. 12; and FIGS. 14 and 15 are enlarged fragmentary sections of the spray nozzles of the floor scrubber shown in FIG. 13, taken in the planes of lines 14-14 and 15-15, respectively.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF PREFERRED EMBODIMENTS

Referring now more particularly to the drawings, there is shown an illustrative floor scrubber 10 in accordance with the invention which comprises a spray or cleaning head 11 having a housing 12, preferably molded of rigid plastic material, that defines a downwardly opening spray or cleaning chamber 14, a spray nozzle assembly 15 disposed within the cleaning chamber 14, and a pivotably adjustable adaptor 16 for connection to a pressurized liquid supply for directing a cleaning fluid, typically water, to the spray nozzle assembly 15 for pressurized direction onto the floor surface during a cleaning operation. The spray nozzle assembly 15 in this case includes a pair of spray nozzles 18 disposed at diametrically opposed ends of a rotary arm 19. The rotary arm 19 is in the form of a pair of radial wings 21 extending from diametrically opposed sides of a central hub 20 parallel to the floor surface to be cleaned for preventing splash back of the sprayed liquid into the spray header housing 12 during a cleaning operation, as will become apparent. Each wing 21 in this instance has a respective integrally liquid supply passage or line 24 communicating between the hub 20 and a respective one of the spray nozzles 18. The nozzles 18, which are removably mounted at opposite radial ends of the wings 21, may be of a conventional type for directing a flat spray pattern in impinging relation to the floor surface to be cleaned.

Figures 5, 7:
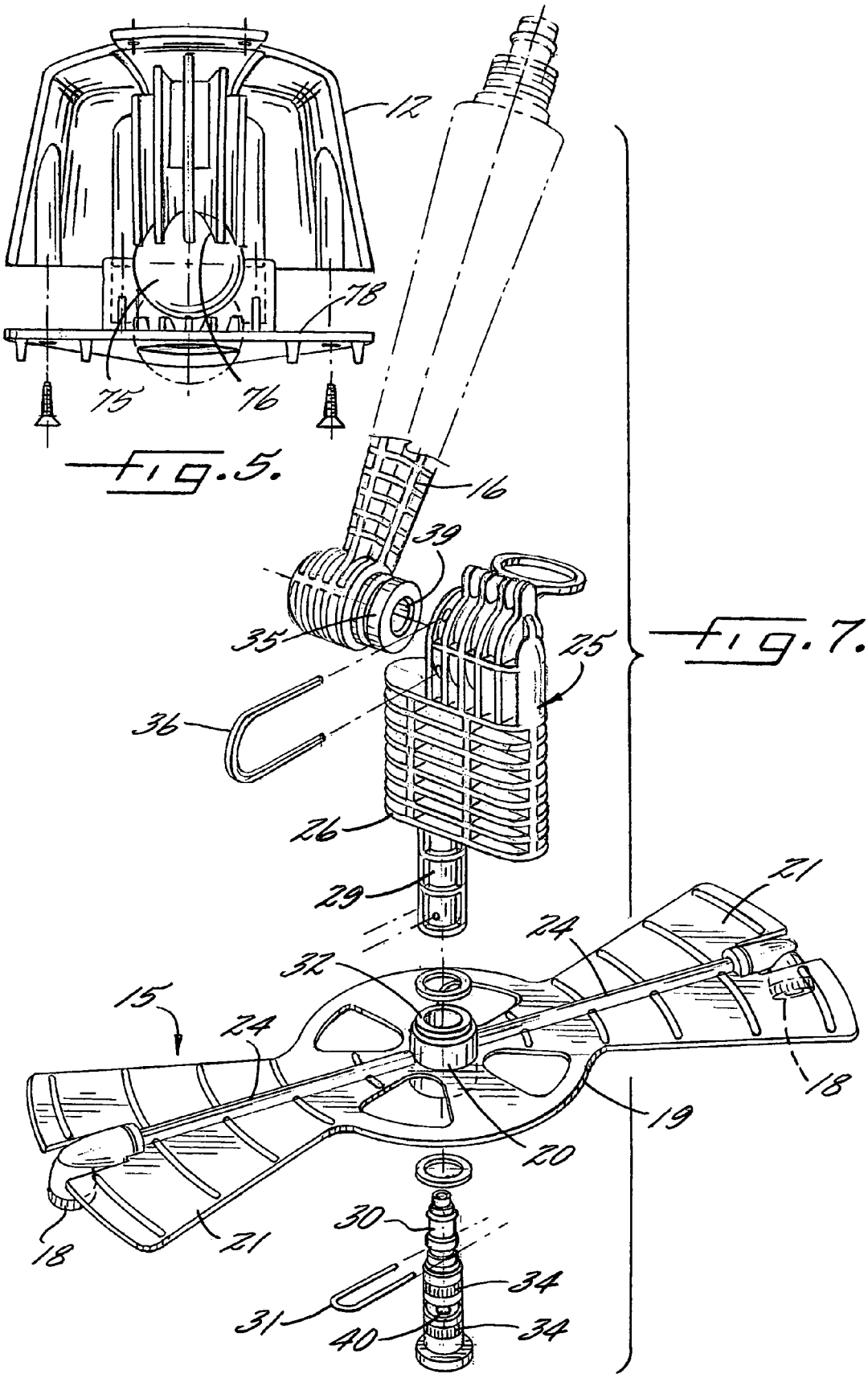
FIG. 5 is an exploded view of one of rotatable ball supports of the illustrated cleaning head, taken in the plane of line 5-5 in FIG. 1.
FIG. 7 is an exploded perspective of the spray nozzle assembly and associated support and liquid supply components for the spray nozzle assembly.
Figure 6:
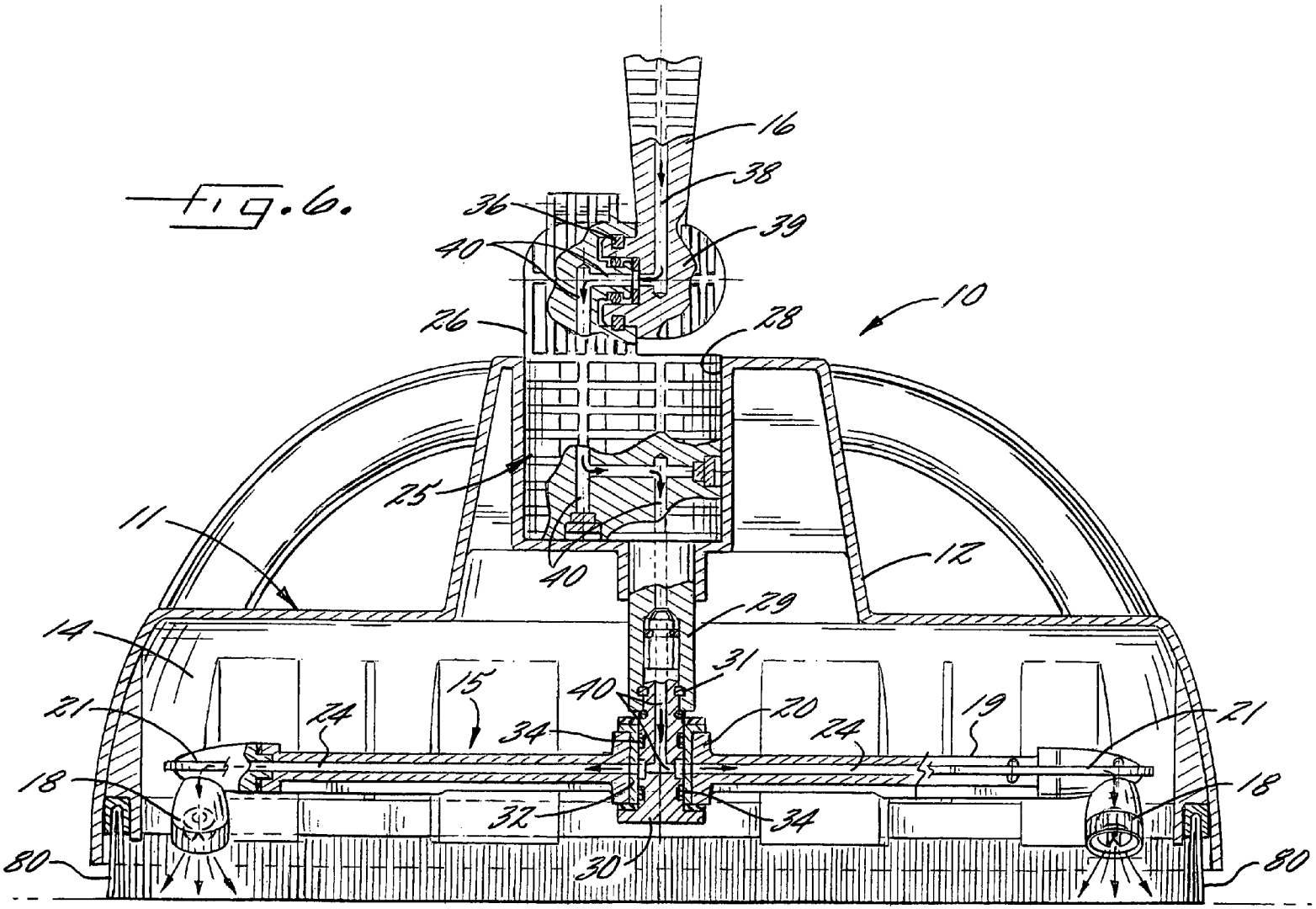
FIG. 6 is an enlarged vertical section of the illustrated cleaning head taken in the plane of line 6-6 in FIG. 2.
Figure 8:
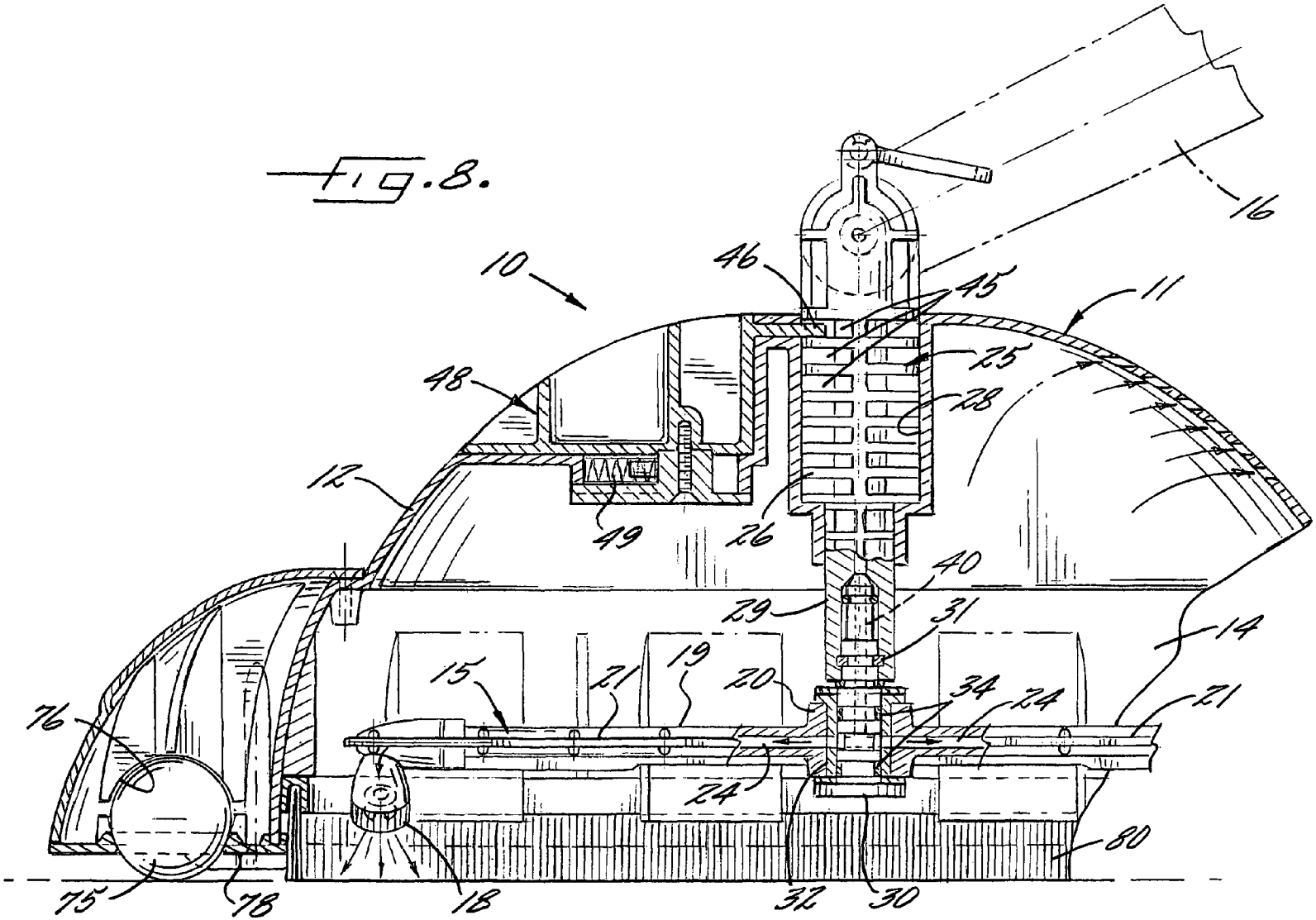
FIG. 8 is an enlarged vertical section of the illustrated floor scrubber, taken in the plane of line 8-8 in FIG. 1, showing the spray nozzle assembly in a latched condition at a predetermined elevation to the floor surface.

For supporting the spray nozzle assembly 15 for rotational movement as an incident to direction of pressurized liquid to the spray nozzles 18, a stationary shaft support assembly 25 secured in the housing includes a non-circular head 26 supported within a correspondingly configured cavity 28 of the housing 12 and a downwardly extending shaft portion 29. The spray nozzle assembly hub 20 is supported for relative rotational movement on a retaining stem 30 positioned into an underside of the shaft portion 29 and secured in mounted position by a clip 31 (FIG. 7). A bushing 32 is fixed within the hub 20 and appropriate annular seals 34 are provided on opposite axial ends thereof. The adaptor 16 in this case has a transversely extending hub 35 mounted for pivotal movement on the shaft assembly head 26, being retained thereon by a U-shaped clamp 36.

For permitting communication of pressurized liquid to the spray nozzle assembly 15, the adaptor 16 has a central flow passageway 38 communicating through the hub 39 with a flow passageway 40 in the head and shaft portion 26, 29. The shaft portion passage 40 in turn communicates through radial passages in the stem 30, bushing 32, and hub 20 with the liquid supply passages 24 in the arms 19 to the respective spray nozzles 18. The spray nozzles 18 are oriented in angled relation to the floor surface such that the direction of pressurized liquid through the nozzles 18 imparts tangential forces for rotating the spray nozzle assembly 15 relative to the shaft portion 29 of the assembly 25.

Figures 9, 9A:
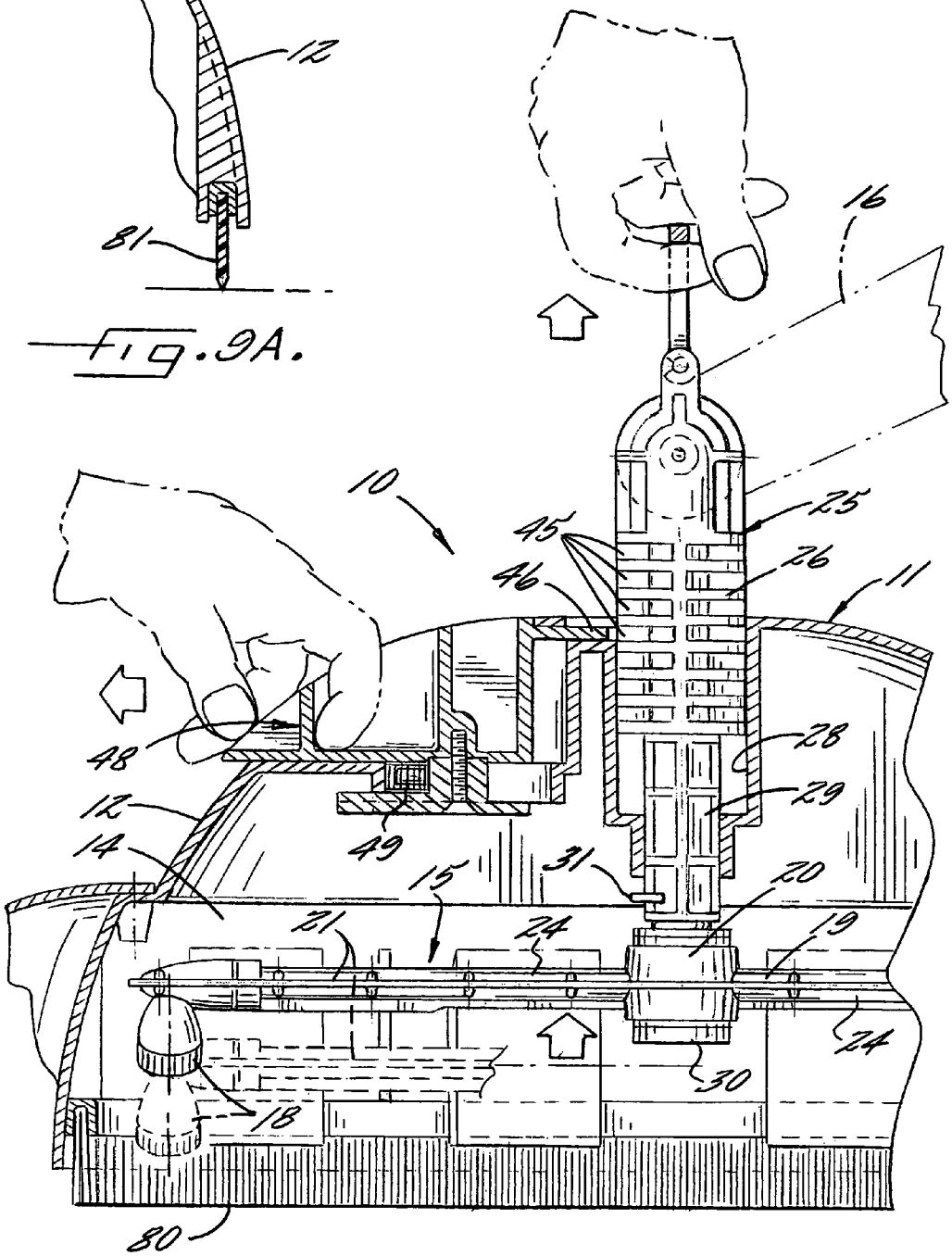
FIG. 9 is an enlarged fragmentary section, similar to FIG. 8, showing actuation of the spray nozzle assembly latching mechanism for facilitating vertical adjustment in the positioning of the spray nozzle assembly to the floor surface.
FIG. 9A is a fragmentary section, showing an alternative embodiment of scrubber head housing having a floor engaging squeegee blade.

For enabling vertical adjustment in the spray assembly 15 relative to the floor surface to be cleaned, the shaft support head 25 has a ribbed construction which defines a plurality of horizontal retention slots 45 each adapted for receiving the locking ledge 46 of a latching member 48 mounted for horizontal movement relative to the housing 12. Manual retraction of the latching member 48 against a force of a biasing spring 49, as depicted in FIG. 9, permits vertical positioning of the shaft assembly 25, and hence the spray nozzle assembly 15, relative to the floor surface. Release of the latching member 48 causes the locking ledge 46 to be biased into a latched condition with a selected shaft head retention slot 45.

Figures 1, 2:
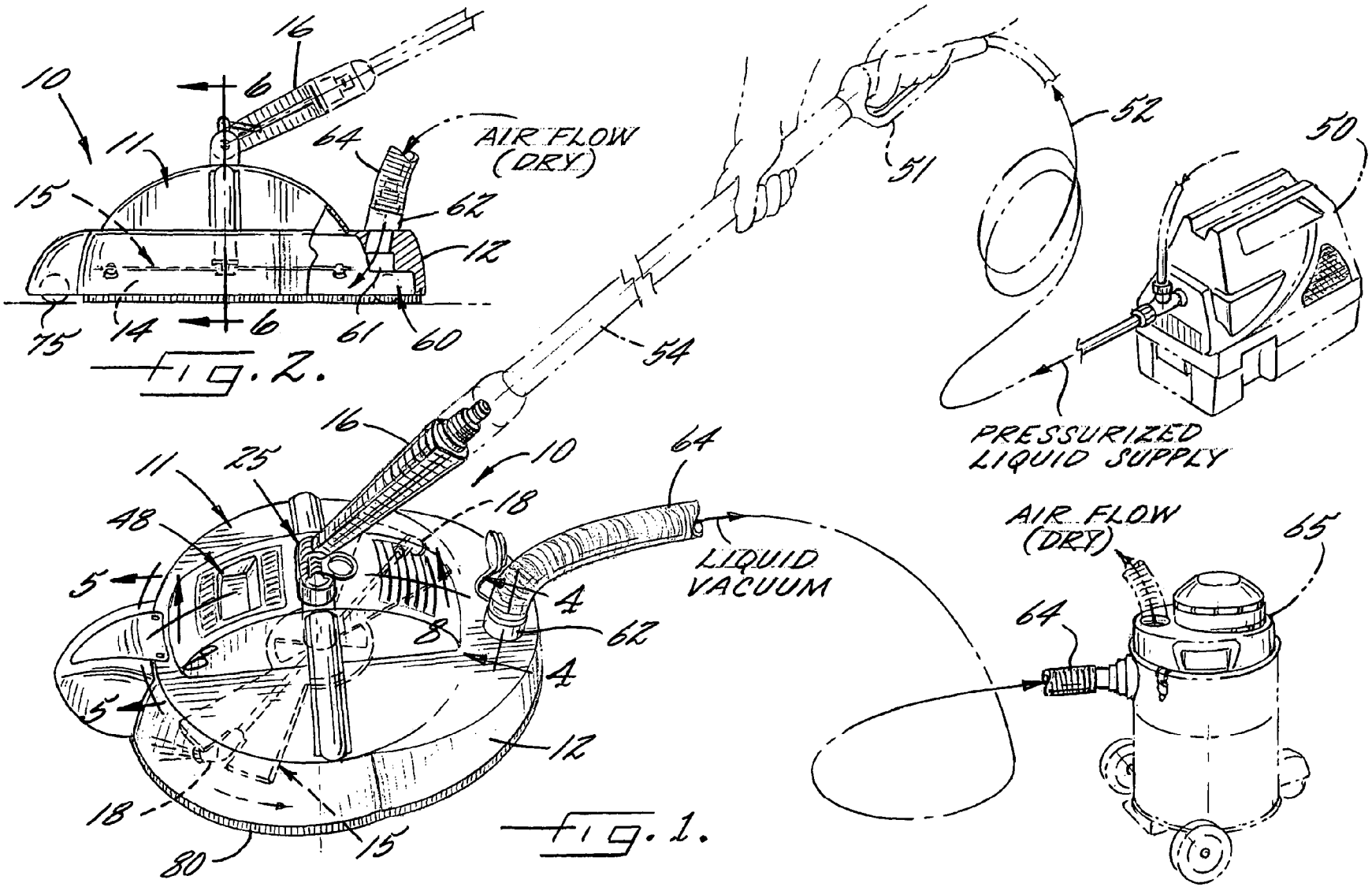
FIG. 1 is a perspective of an illustrative floor scrubber in accordance with the invention being used with a conventional pressure washer and wet/dry vacuum.
FIG. 2 is a side elevational view of the cleaning head of the illustrated scrubber.

For directing a cleaning liquid to the floor scrubber 10, the adaptor 16 may be connected to a suitable pressurized liquid supply source, such as a pressure washer pump 50 of a conventional type, as depicted in FIG. 1, which may be available on the premises of the user. Such pressure washer pump 50, which may be gas or electric powered, typically includes a control handle or gun 51 connected to the pressure washer pump 50 by a high pressure liquid hose 52 and a wand 54 that can be releaseably connected to the adaptor 16 of the floor scrubber 10 by an appropriate quick disconnect coupling, such as a bayonet coupling or the like. Through operation of the pressure washer pump 50, a cleaning fluid, typically water, may be directed to the floor scrubber head 11 for forceful discharge against the floor surface to be cleaned by the spray nozzles 18, while simultaneously causing rotational movement of the spray nozzle assembly 15. The gun 51 typically includes a trigger valve for allowing the operator to selectively control the supply of pressurized fluid to the scrubber during a cleaning operation.

In accordance with an important aspect of the invention, the floor scrubber is operable for removing liquid directed onto the floor surface during a cleaning operation, either simultaneously with the cleaning operation or subsequent thereto. To this end, the floor scrubber head has a suction chamber or zone that may be coupled to a suitable suction pressure source. In the illustrated embodiment, as shown in FIGS. 2-3, the spray head housing 12 is formed with a downwardly opening walled suction chamber 60, separate from the spraying and washing chamber 14, that has a suction opening 61 in close proximity to the floor surface. The suction chamber 60 in this case is defined by integral walls of the housing 12 on a rear side of the housing 12 and the suction opening 61 has a substantially elongated rectangular shape with a long axis oriented transverse to the forward direction of movement of the scrubber during usage. The suction chamber 60 has an adaptor 62 fixed to the upper rear end of the housing 12 communicating with the suction chamber 60 to which a flexible vacuum hose 64 may be connected.

In keeping with the invention, the floor scrubber 10 can be used with a conventional wet/dry vacuums 65, such as a canister type wet/dry vacuums commercially sold under the name Shop Vac. It will be understood that any suitable wet/dry vacuum could be used that is operable for vacuuming and receiving liquids. To that end, the adaptor 62 is inwardly tapered in an outward direction from the housing 12 for receiving different size vacuum lines or hoses 64 of a wet/dry vacuum 65 that might be possessed by the user. The adaptor 62 in this case has a stepped configuration with three different sized cylindrical hose mounting surface 66, 67, 68, each for receiving in sealed relation a different sized standard vacuum hose 65, such as a 1¼, 1½, 2 inch hose. Each cylindrical mounting surface in this case has an annular sealing ring 69 to facilitate sealed engagement and retention of the particular sized hose. Alternatively, as depicted in FIG. 4A, the adaptor 62 may have a conical configuration with a plurality of axially spaced sealing rings 69. In this case, it will be seen that different sized hose can be forcefully positioned onto the conical adaptor 62 with frictional engagement and with one of the O-rings 69 providing auxiliary sealing.

In carrying out the invention, the spray head 11 is supported for movement over the floor by a plurality of rotatable balls 75 which enable the spray head to be easily moved in random 360° directions over the floor during a cleaning operation and which maintain the vacuum opening 61 in predetermined close relation to the floor surface for effective removal of liquid that has been directed onto the floor surface. In the illustrated embodiment, the spray head housing 12 is supported by three roller balls 75, with one ball 75 being disposed forwardly of the cleaning chamber 14 and two balls 75 being disposed rearwardly of the washing chamber 14 adjacent opposite elongated ends of the suction opening 61.

For receiving and retaining the balls 75 for rolling movement in the underside of the spray head housing 12, the housing 12 is formed with respective downwardly opening ball containing sockets 76 in the underside thereof. The balls 75 are retained within the sockets 76 for relative rotational movement by respective retaining plates 78 screwed or otherwise fixed to the underside of the housing 12. The plates 78 each are formed with a respective opening sized less than the diameter of the balls 75 for retaining the balls within the sockets 76 with a predetermined relatively small portion thereof protruding through the plate for supporting the housing 12 in closely spaced predetermined relation to the floor surface. It has been found that the rolling ball support for the spray header 11 permits the housing to be maintained in close relation to even slightly irregular or rough surfaced floors, such as asphalt, for enhancing cleaning and liquid removal.

For sealing the vacuum chamber 60 with the floor surface while simultaneously enhancing scrubbing action with the floor, the outer lower perimeter of the housing 12 has depending brush bristles 80 that define a flexible sealing wall for sliding engagement with the floor surface. It can be seen that such bristles 80 effectively seal the lower outer perimeter of the housing 12 with the floor surface from the outside environment, while at the same time positively engaging in scrubbing the floor surface as an incident to movement of the scrubber over the floor. The bristles 80 further effectively accommodate and seal irregularities in the floor surface for enhanced vacuum removal of the liquid. Alternatively, a rubber squeegee blade 81, as depicted in FIG. 9A, could be provided in place of the bristles. Such squeegee blade 81 is particularly effective for maintaining the liquid within the perimeter of the housing during cleaning of smooth flat floor surfaces for subsequent vacuum removal.

In carrying out still a further aspect of the invention, the floor scrubber 10 is operable for directing pressurized air onto the floor following vacuum removal of the liquid from a cleaning operation for enhancing quicker drying of the floor surface. To this end, the wet/dry vacuum 65 may be a conventional type that further is operable for directing a positive pressure air discharge through the vacuum line 64. In that case, following a cleaning operation and vacuum removal of the liquid directed onto the floor during a cleaning operation, the wet/dry vacuum 65 may be operated to direct a positive air flow into the vacuum chamber 60 of the housing and through the vacuum opening 61 onto the floor surface for enhanced drying of the floor surface as shown in FIG. 2. Again, the rolling support balls 75 for the spray header enables the scrubber head to be randomly moved over the floor surface for selective direction of the positive air stream on remaining wet areas of the floor as required.

Figure 10:
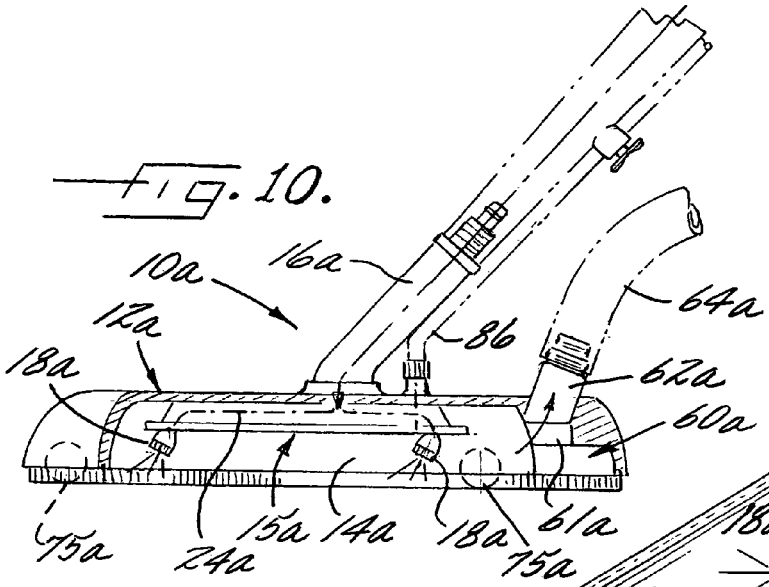
FIG. 10 is a fragmentary vertical section of an alternative embodiment of floor scrubber in accordance with the invention.
Figure 11:
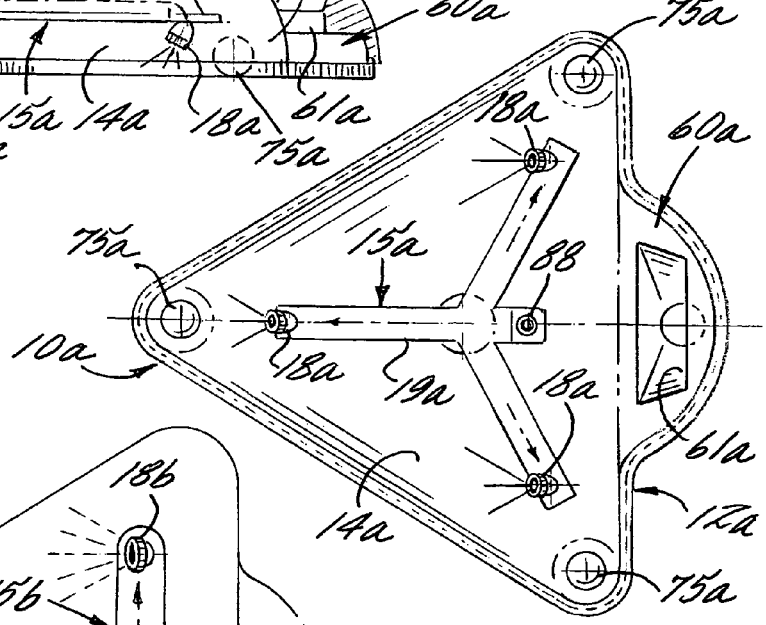
FIG. 11 is an underside view of the floor scrubber shown in FIG. 10.

Referring now to FIGS. 10 and 11, there is shown an alternative embodiment of floor scrubber wherein items similar to those described above have been given similar reference numerals with the distinguishing suffix "a" added. The floor scrubber 10*a* in this case has a triangular configured downwardly opening housing 12*a* which defines a cleaning chamber 14*a* and a separate vacuum chamber 60*a* at a rear end thereof. The housing 12*a* again has downwardly directed floor engaging and sealing bristles 80*a* about a lower perimeter, an adaptor 16*a* for connection to a pressurized liquid supply, and an adaptor 62*a* for connection to a vacuum pressure source.

A spray nozzle assembly 15*a* in this case is fixedly supported in the underside of the housing 12*a* and comprises a multi-legged support 19*a* which each defines a liquid flow passageway communicating between the liquid supply adaptor 16*a* and a spray nozzle 18*a* supported at the outer end of the leg. The spray nozzles 18*a* again preferably are fan spray nozzles, such as fan spray nozzles commercially available from Arrow Line SrL, Rubiera (RE) Italy, which have adjustable parallel blades 85, as depicted in FIG. 15 for establishing the desired width of the discharging fan spray pattern. The housing 12*a* again is supported by a plurality of roller balls 75, in this case located at respective corners of the triangular configured housing 12*a*.

In carrying out this embodiment of the invention, a separate chemical supply line 86 is provided for connection with a chemical inlet 88 communicating with the cleaning chamber 14*a*. Hence, simultaneous with the supply of water to the spray nozzles 18*a*, a chemical may be introduced into the cleaning chamber 14*a* and onto the floor surface during the cleaning operation.

Referring now more to FIGS. 12 and 13, there is shown still a further alternative embodiment of a floor scrubber in accordance with the invention wherein items similar to those described above have been given similar reference numerals with the distinguishing suffix "b" added. The floor scrubber 10*b* in this case again has a triangular configured downwardly opening housing 12*b* with three spray nozzles 89, 18*b* mounted on a fixed support 19*b* for communicating with a pressurized liquid supply. In this case, the multi-legged support 19*b* has a general T-shape, with spray nozzles 18*b* supported at opposite ends of the support 19*b* being flat spray nozzles as described above and with the forward nozzle 89 being a turbo nozzle for generating an agitated spray pattern for more aggressive cleaning of the floor surface. The turbo nozzle 89 again may be of a known type, such as offered by Arrow Line SrL, having a downwardly opening nozzle body that contains a floating agitator 90, as depicted in FIG. 14. Liquid introduced into the nozzle 89 is tangentially directed into the nozzle body for turbulent agitation by the floating agitator 90, prior to discharge from the nozzle onto the floor surface. It has been found that such turbo nozzle is effective for creating a more aggressive agitating spray discharge onto the floor surface for enhanced dislodgement of dirt and grime, while the fan spray nozzles 18*b* tend to sweep the removed dirt particulate material along within the housing for subsequent vacuum removal.

From the foregoing, it can be seen that the floor scrubber of the present invention is adapted for easier and more efficient usage in cleaning floors. The scrubber eliminates the necessity for later mopping of water directed onto the floor during the cleaning operation by effecting vacuum removal of the applied liquid, either simultaneously or subsequent to a cleaning operation. The liquid floor scrubber, which is adapted for versatile usage with pressure washers and wet/dry vacuums that may be available on the users premises, further can be operated with monitored supply of chemicals during cleaning, and for the direction of positive pressurized air onto the floor surface for enhanced drying.

The invention claimed is:

1. A floor scrubber for cleaning floor surfaces comprising:

a cleaning head having a housing defining a downwardly opening cleaning zone, at least one spray nozzle supported within said cleaning zone, said cleaning head having a liquid inlet connectable to a pressurized liquid supply for directing cleaning fluid to said at least one nozzle, said liquid inlet being defined by a pivotably mounted adaptor, said adaptor defining a liquid flow passageway for communicating liquid from said liquid inlet to said at least one spray nozzle, a pump having a control wand connectable to said adaptor for directing pressurized liquid to said liquid inlet and through said liquid passageway and said at least one spray nozzle, said housing further defining a vacuum zone, and said vacuum zone having a vacuum pressure inlet connectable to a vacuum pressure source.

2. The floor scrubber of claim 1 in which said vacuum zone is disposed adjacent only a section of a perimeter of the cleaning zone.

3. The floor scrubber of claim 1 including a plurality of spray nozzles mounted on a spray nozzle assembly rotatably supported within said housing, and said spray nozzle assembly being rotatable in response to the flow of liquid through said nozzles.

4. A floor scrubber for cleaning floor surfaces comprising:

a cleaning head having a housing defining a downwardly opening cleaning zone, an adjustable spray nozzle assembly supported within said housing including a plurality of spray nozzles for directing pressurized liquid flow streams, wherein said spray assembly may be vertically adjusted within said housing, said housing having a liquid inlet for directing pressurized liquid from a pressurized liquid supply to said spray nozzle assembly, said plurality of spray nozzles including at least one turbo nozzle having a turbulence creating internal agitation member for agitating the flow stream, and at least two of said plurality of nozzles being fan spray nozzles for generating fan spray patterns.

5. The floor scrubber of claim 4 in which said housing defines a separate vacuum zone disposed adjacent only a section of a perimeter of the cleaning zone, and said housing having a vacuum inlet connectable to a vacuum pressure source for creating a vacuum pressure within said vacuum zone.

6. A floor scrubber for cleaning floor surfaces comprising:

a cleaning head having a housing defining a downwardly opening cleaning zone, at least one spray nozzle supported within said cleaning zone, said cleaning head having a liquid inlet connectable to a pressurized liquid supply, said housing further defining a vacuum zone, said vacuum zone having a vacuum pressure inlet connectable to a vacuum pressure source, said vacuum inlet being defined by an adaptor connected to said housing, and said adaptor having a tapered outer surface that narrows as it extends outwardly from said housing for accommodating engagement to different sized vacuum lines selectable for use in connecting a vacuum inlet to said vacuum pressure source.

7. The floor scrubber of claim 6 in which said vacuum inlet defining adaptor has a stepped outer surface defined by a plurality of cylindrical surfaces of progressively smaller diameters as it extends outwardly from said housing.

8. The floor scrubber of claim 6 in which said adaptor has a conical configuration.

9. The floor scrubber of claim 6 wherein the outer surface of the adaptor further includes a plurality of longitudinally spaced sealing rings.

10. A floor scrubber for cleaning floor surfaces comprising:

a cleaning head having a housing defining a downwardly opening cleaning zone, at least one spray nozzle supported within said cleaning zone, said cleaning head having a liquid inlet connectable to a pressurized liquid supply, said housing further having a vacuum zone separate from said cleaning zone, said vacuum zone having a vacuum pressure inlet connectable to a vacuum pressure source, said vacuum zone being within the housing and being disposed adjacent only a section of a perimeter of the cleaning zone; and a plurality of rolling elements disposed within a lower perimeter of said housing and supporting said lower perimeter in a predetermined spaced relation to the floor surface, at least two of said plurality of rolling elements being disposed outside of a forward longitudinal path of said vacuum zone.

11. The floor scrubber of claim 10 further including a plurality of roller balls disposed within an underside of said housing for supporting the cleaning head in predetermined closely spaced relation from the floor surface.

12. The floor scrubber of claim 10 wherein said liquid inlet being defined by an adaptor that is configured to receive a portion of a control wand that is connected to said pressurized liquid supply; wherein said control wand and adaptor define a handle for use in moving the floor scrubber over a floor surface.

13. A floor scrubber cleaning head for cleaning floor surfaces comprising:

a housing defining a downwardly opening cleaning zone and a vacuum zone separate from said cleaning zone, wherein said vacuum zone is within the housing and is disposed adjacent only a portion of a perimeter of said cleaning zone;

at least one spray nozzle positioned within said cleaning zone, a liquid inlet connectable to a pressurized liquid supply for directing fluid to said at least one nozzle;

a vacuum inlet connectable to a vacuum pressure source; and a plurality of rolling elements disposed within a lower perimeter of said housing and supporting said lower perimeter in a predetermined spaced relation to the floor surface, at least two of said plurality of rolling elements being disposed outside of a forward longitudinal path of said vacuum zone.

14. The floor scrubber cleaning head of claim 13 wherein said vacuum inlet is further defined by an adaptor connected to said housing, and said adaptor having a tapered outer surface for engaging different sized vacuum lines used to connect said vacuum inlet to said vacuum pressure source.

15. The floor scrubber cleaning head of claim 13 further including a flexible barrier medium depending from said housing surrounding said cleaning and vacuum zones.

16. The floor scrubber of claim 15 in which said barrier medium includes brush bristles supported in depending relation about a perimeter of the housing.

17. The floor scrubber of claim 15 in which said barrier medium includes a squeegee blade fixed in depending relation about a perimeter of said housing.

18. A method of cleaning a floor surface comprising the steps of:

providing a floor scrubber, comprising:

a cleaning head having:

a housing defining a downwardly opening cleaning zone and a vacuum zone separate from said cleaning zone, wherein said vacuum zone is within the housing and is disposed adjacent only a portion of a perimeter of said cleaning zone;

at least one spray nozzle positioned within said cleaning zone, a liquid inlet;

a vacuum inlet; and a plurality of rolling elements disposed within a lower perimeter of said housing and supporting said lower perimeter in a predetermined spaced relation to the floor surface, at least two of said plurality of rolling elements being disposed outside of a forward longitudinal path of said vacuum zone;

connecting the liquid inlet to a pressure washer to supply pressurized liquid to said at least one spray nozzle;

connecting a vacuum source with a vacuum tank to said vacuum inlet;

spraying at least a portion of said pressurized liquid into the cleaning zone; and vacuuming at least a portion of said pressurized liquid from said floor surface, through the vacuum zone of said cleaning head and into said vacuum tank.

19. The method of claim 18 wherein the vacuum source is a wet/dry vacuum device and comprising the further step of redirecting the wet/dry vacuum device to provide positive pressure air flow into said vacuum inlet and vacuum zone for facilitating drying of the floor surface.

* * * * *